US011174596B2

(12) United States Patent
Stoeffler

(10) Patent No.: US 11,174,596 B2
(45) Date of Patent: Nov. 16, 2021

(54) TISSUE PRODUCT AND METHOD AND APPARATUS FOR PRODUCING SAME

(71) Applicant: Essity Hygiene and Health Aktiebolag, Gothenburg (SE)

(72) Inventor: Yves Stoeffler, Kunheim (FR)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/287,598

(22) PCT Filed: Dec. 13, 2018

(86) PCT No.: PCT/IB2018/001586
§ 371 (c)(1),
(2) Date: Apr. 22, 2021

(87) PCT Pub. No.: WO2020/121013
PCT Pub. Date: Jun. 18, 2020

(65) Prior Publication Data
US 2021/0310198 A1 Oct. 7, 2021

(51) Int. Cl.
*D21H 27/40* (2006.01)
*D21H 27/02* (2006.01)
(Continued)

(52) U.S. Cl.
CPC ..... *D21H 27/40* (2013.01); *B31F 1/07* (2013.01); *D21H 27/002* (2013.01); *D21H 27/02* (2013.01); *D21H 27/32* (2013.01); *B31F 2201/0738* (2013.01); *B31F 2201/0764* (2013.01); *B31F 2201/0787* (2013.01); *B31F 2201/0797* (2013.01)

(58) Field of Classification Search
USPC ..... 162/116
See application file for complete search history.

(56) References Cited

U.S. PATENT DOCUMENTS 5,893,965 A * 4/1999 Trokhan ..... D21F 11/006 162/205
8,007,640 B2 * 8/2011 Boatman ..... B31F 1/07 162/362

(Continued)

FOREIGN PATENT DOCUMENTS

WO 2007030592 A2 3/2007
WO 2009010092 A1 1/2009

OTHER PUBLICATIONS

International Preliminary Report on Patentability (PCT/IPEA/409) dated Nov. 4, 2020, by the European Patent Office as the International Preliminary Examining Authority for International Application No. PCT/IB2018/001586. (11 pages).

(Continued)

*Primary Examiner* — Mark Halpern
(74) *Attorney, Agent, or Firm* — Buchanan Ingersoll & Rooney PC

(57) ABSTRACT

A tissue product includes at least one ply with embossed protrusions defining an interior volume, the embossed protrusions including a base, a top surface and a sidewall extending from the top surface to the base, wherein the sidewall of at least 10% of the embossed protrusion is provided with an indent region shaped such that the sidewall bends towards the interior volume of the embossed protrusion.

23 Claims, 3 Drawing Sheets

(51) Int. Cl.

| | |
|---|---|
| ***D21H 27/00*** | (2006.01) |
| ***D21H 27/32*** | (2006.01) |
| ***B31F 1/07*** | (2006.01) |

(56) References Cited

U.S. PATENT DOCUMENTS

| | | | | |
|---|---|---|---|---|
| 11,000,428 | B2 * | 5/2021 | Orr | B32B 3/08 |
| 2007/0059495 | A1 * | 3/2007 | Wilke, II | D21H 27/02 428/180 |
| 2007/0137813 | A1 * | 6/2007 | Nickel | B31F 1/07 162/109 |
| 2007/0144694 | A1 * | 6/2007 | Pringle | D21F 5/182 162/117 |
| 2009/0126885 | A1 | 5/2009 | Akai et al. | |
| 2009/0311481 | A1 * | 12/2009 | Morin | D21H 27/40 428/172 |
| 2010/0136291 | A1 * | 6/2010 | Graff | B31F 1/07 428/154 |
| 2010/0183850 | A1 * | 7/2010 | Sauter | B31F 1/07 428/172 |
| 2013/0344294 | A1 * | 12/2013 | Eilert | B32B 29/08 428/172 |

OTHER PUBLICATIONS

International Search Report (PCT/ISA/210) and Written Opinion (PCT/ISA/237) dated Apr. 24, 2019, by the European Patent Office as the International Searching Authority for International Application No. PCT/IB2018/001586. (9 pages).

* cited by examiner

TISSUE PRODUCT AND METHOD AND APPARATUS FOR PRODUCING SAME

TECHNICAL FIELD

The disclosure relates to a tissue product, a method of producing such tissue product and an apparatus for carrying out the method for producing such tissue product.

BACKGROUND

Hygiene or wiping products primarily include all kinds of dry-creped tissue paper, wet-creped paper, TAD-paper (Through Air Drying) and cellulose or pulp-wadding or all kinds of non-wovens, or combinations, laminates or mixtures thereof. Typical properties of these hygiene and wiping products include the reliability to absorb tensile stress energy, their drapability, good textile-like flexibility, properties which are frequently referred to as bulk softness, a high surface softness and a high specific volume with a perceptible thickness. A liquid absorbency as high as possible and, depending on the application, a suitable wet and dry strength as well as an appealable visual appearance of the outer product's surface are desired. These properties, among others, allow these hygiene and wiping products to be used, for example, as cleaning wipes such as paper or non-woven wipes, windscreen cleaning wipes, industrial wipes, kitchen paper or the like; as sanitary products such as for example bathroom tissue, paper or non-woven handkerchiefs, household towels, towels and the like; as cosmetic wipes such as for example facials and as serviettes or napkins, just to mention some of the products that can be used.

Furthermore, the hygiene and wiping products can be dry, moist, wet, printed or pretreated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, remove dust, for wrapping or even just as supporting material, as is common for example in medical practices or in hospitals.

If tissue paper is to be made out of pulp, the process can include a forming that includes a box and a forming wire portion, and a drying portion, either through air drying or conventional drying on a yankee cylinder. The production process also usually includes a crepe process and, finally, typically a monitoring and winding area.

Paper can be formed by placing the fibers, in an oriented or random manner, on one or between two continuously revolving wires of a paper making machine while simultaneously removing the main quantity of water of dilution until dry-solids contents of usually between 12 and 35% are obtained.

Drying the formed primary fibrous web occurs in one or more steps by mechanical and thermal means until a final dry-solids content of usually about 93 to 97% has been reached. In case of tissue making, this stage is followed by the crepe process which crucially influences the properties of the finished tissue product in conventional processes. The conventional dry crepe process involves creping on a usually 4.0 to 6.5 m diameter drying cylinder, the so-called yankee cylinder, by means of a crepe doctor with the aforementioned final dry-solids content of the raw tissue paper. Wet creping can be used as well, if lower demands are made of the tissue quality. The creped, finally dry raw tissue paper, the so-called base tissue, is then available for further processing into the paper product for a tissue paper product.

Instead of the conventional tissue making process described above, the use of a modified technique is possible in which an improvement in specific volume is achieved by a special kind of drying which leads to an improvement in the bulk softness of the tissue paper. This process, which exists in a variety of subtypes, is termed the TAD (Through Air Drying) technique. The technique can include the "primary" fibrous web leaving the forming and sheet making stage pre-dried to a dry-solids content of about 80% before final contact drying on the yankee cylinder by blowing hot air through the fibrous web. The fibrous web is supported by an air-permeable wire or belt or TAD-fabric and during its transport is guided over the surface of an air-permeable rotating cylinder drum, the so-called TAD-cylinder. Structuring the supporting wire or belt makes it possible to produce any pattern of compressed zones broken up by deformation in the moist state, also named moulding, resulting in increased mean specific volumes and consequently leading to an increase of bulk softness without decisively decreasing the strength of the fibrous web.

The processing step from the base tissue that has already been optionally wound up in several plies to the finished tissue product occurs in processing machines (converting machines) which can include operations such as unwinding the base tissue, repeated smoothing of the tissue, printing embossing, to an extent combined with full area and/or local application of adhesive to produce ply adhesion of the individual plies to be combined together as well as longitudinal cut, folding, cross cut, placement and bringing together a plurality of individual tissues and their packaging as well as bringing them together to form larger surrounding packaging or bundles. Such processing steps may also include application of substances like scents, lotions, softeners or other chemical additives.

The individual paper ply webs can also be pre-embossed and then combined in a roll gap according to the embossing methods known in the art. Any embossing can lead to embossed elements all having the same height or to embossing elements having different heights. Ply bonding, e.g. by mechanical or by chemical means are other well-known methods mainly used for hankies, napkins and bathroom tissues.

A well-known technique to increase the thickness of a paper product is to emboss the paper web. An embossing process is carried out in the nip between an embossing roll and an anvil roll. The embossing roll can have protrusions or depressions on its circumferential surface leading to embossed protrusions in the paper web.

Anvil rolls may be softer than the corresponding embossing roll and may be formed of rubber, such as natural rubber, or plastic materials, paper or steel.

For manufacturing multi-ply tissue products, especially bathroom tissue and household tissue, three manufacturing methods for embossing and adhesively bonding of the plies have established. These are Goffra Incolla/spot embossing, DESL (Double Embossing Single Lamination)/Nested, and Pin-to-Pin/Foot-to-Foot.

In the first mentioned manufacturing method, Goffra Incolla, a first web is directed through the nip between an embossing roll and an anvil roll. In this nip the web is provided with an embossing pattern. Thereafter, an application roll for adhesive applies adhesive to those parts of the first web at which there are protruding embossing elements in the embossing roll. The adhesive is transported from an adhesive bath via an adhesive transfer roll to the application roll. A second web is transported to the first web and adhesively bonded to the first web in the nip between the so-called marrying roll and the embossing roll. The adhesive bonding takes place at those portions at which the adhesive was applied.

The second manufacturing method (DESL/Nested) is very similar to the above-described Goffra Incolla method. It includes an additional pair of rolls made of a second embossing roll and a second anvil roll. The additional pair of rolls serves to emboss the second web before it is adhesively bonded to the first web using the marrying roll. Typically, the additional pair of rolls is placed close to the first pair of rolls and the marrying roll. Especially when using the so-called Nested-method such close arrangement is important. The Nested-method can be considered as a special case of the general DESL-manufacturing method. For the Nested-method the embossing elements of the first embossing roll and the embossing elements of the second embossing roll are arranged such that the embossed elements of the first embossed ply and the embossed elements of the second embossed ply fit into each other similar to a gearing system. This serves to achieve a mutual stabilization of the two plies. However, for the DESL manufacturing method such correlation between the embossed elements of the first, upper ply and the second, lower ply, does not have to apply. Nevertheless, in the literature the term DESL is often used synonymous to a Nested-method.

The third manufacturing method (Pin-to-Pin/Foot-to-Foot) is similar to the DESL method. By means of two pairs of rolls both the upper ply and the lower ply are embossed, respectively. Adhesive is applied onto the embossed protrusions of the first ply. The ply bonding however, is not achieved by means of a marrying roll as in the DESL method but is achieved directly by means of the protruding embossing elements of the second embossing roll. In order to achieve this, an exact adjustment of the width of the nip between the first embossing roll and the second embossing roll is required, which is mainly defined by the individual thickness of both webs (upper ply and lower ply). Further, the embossing rolls have to be designed such that the protruding embossing elements of both rolls face each other. This is the reason why the terminology Pin-to-Pin or Foot-to-Foot embossing is used.

All above described methods have the following common features: the first embossing roll is formed of a hard material, usually metal, especially steel, but there are also known embossing rolls made of hard rubber or hard plastics materials. The embossing rolls can be a male roll having individual protrusions. Alternatively, the embossing roll can be a female roll with individual embossing depressions. Typical depths of the engraved embossing patterns are between 0.4 and 2.0 m.

The anvil roll typically has a rubber coating with a hardness between 35 Shore A and 85 Shore A. However, structured anvil rolls, especially rolls made of paper, rubber or plastics materials or steel are also known.

The applicator roll for adhesive is usually also a rubber roll with a plain smooth circumferential surface, wherein the hardness of the rubber coating is between the hardness of the anvil roll and the hardness of the marrying roll. Commonly used values for the hardness of the rubber coating are 70 to 85 Shore A. When selecting the rubber material its compatibility with the adhesive to be applied has to be ensured.

The application system for adhesive including applicator roll, adhesive transfer roll and adhesive bath can be designed as a so-called immersion roll system in which the adhesive transfer roll is immersed into the adhesive bath and transports adhesive by means of surface tension and adhesive forces out of the adhesive bath. By adjusting the gap between the adhesive transfer roll and the applicator or application roll, the amount of adhesive to be applied can be adjusted. Application rolls may be structured rolls. Recently, adhesive transfer rolls have become known having defined pit-shaped depressions in their circumferential surface. Such adhesive transfer rolls are known as Anilox-rolls. Such roll is usually made of ceramic material or it is a roll made of steel or copper and coated with chromium. Excessive adhesive is removed from the surface of the Anilox-roll by means of a blade. The amount of adhesive is determined by the volume and the number of depressions. Alternative application systems for applying adhesives are based on a spraying equipment (Weko-technique).

A second possibility to influence the amount of adhesive transferred is the adjustment of the difference in circumferential speeds of the adhesive transfer roll and the applicator roll. Typically, the adhesive transfer roll rotates slower than the applicator roll. The circumferential speed of the adhesive transfer roll is usually between 5% and 100% of the first circumferential speed of the applicator roll. The adhesive bath can be designed as a simple trough, application systems with a blade can also be designed as chamber systems.

The embossing technologies Goffra Incolla/spot embossing and DESL/Nested, both use an additional roll, the so-called marrying roll for laminating together the plies. The marrying roll commonly has a smooth rubber surface with a hardness of about 90-95 Shore A. A suitable material is e.g. NBR (acrylnitrile-butadien rubber). However, marrying rolls also have become known which, in addition to the rubber coating, are provided with a steel coating. Such steel coating is often provided in form of a steel band spirally wound onto the rubber coating. In case that the single layers individually or together are pre-embossed, a so-called micro-pre-embossing device is used. Such pre-embossing device is often used in combination with the Goffra Incolla technology. Also commonly used is a printing onto the tissue product before or after the ply bonding step. Also known are variants including the application of chemical substances, especially lotions and softeners.

Another well-known embossing technique includes a steel embossing roll and a corresponding anvil steel roll (so-called Union embossing). The surfaces of these rolls are being formed in such a manner that deformation of the paper and mechanical ply bonding without using adhesives are achieved within one single embossing step.

When using all of the above described three embossing methods it is advantageous to provide a control for the tension of the web both before and after the ply bonding because the physical properties of the web and especially the stress-strain characteristic can be changed significantly in the embossing step.

The embossing not only serves to provide bulk to the fibrous product but also to provide an improved optical appearance to the product. The optical appearance can be improved by combining embossing and coloring steps. Another reason for embossing is to generate higher absorbency or improved perceived softness.

SUMMARY

It is the object of the invention to provide a tissue product with reduced thickness which has an increased softness and a good absorbency, a method for producing such product and an apparatus for carrying out such method.

This object is solved by a tissue product with the features of claim 1, a method for producing such product with the features of claim 14 and an apparatus for carrying out such method. Preferred embodiments follow from the other claims.

In an aspect, the tissue product includes at least one ply with embossed protrusions defining an interior volume, the embossed protrusions including a base, a top surface and sidewalls extending from the top surface of the base, wherein the side wall of at least 10% of the embossed protrusion is provided with an indent region shaped such that the side wall bends towards the interior volume of the embossed protrusion.

In other words, parts of the embossed protrusions have a specific shape with a sidewall which is inwardly folded, i.e. folded towards the interior volume of the embossed protrusion. It should be noted that reference to "folding" does not exclude the existence of small radii. For each embossed protrusion with an indent region as claimed, the initially embossed protrusion is compressed such that its initial height and initial interior volume as provided after embossing are reduced. In the following, a distinction will be made between the embossed protrusion and the initial embossed protrusion with its initial interior volume and initial height which are those after the embossing of the tissue web and before the geometry of the embossed protrusion with indent region is generated in a subsequent protrusion compression unit. When compressing the initial embossed protrusion, its initial height is reduced and the material forming the sidewall of the embossed protrusion forms an indent towards the interior volume and reduces the initial interior volume.

According to an embodiment, at least 20% of the protrusions, at least 30%, at least 50%, at least 60%, at least 70%, at least 80%, or at least 90% of the protrusions are provided with the indent region. In other words, a proportion as high as possible of protrusions with an indent region is advantageous.

Such a specific shape of the embossed protrusions has several advantages for the tissue product. Firstly, it is thinner as compared to tissue product having the same embossed geometry but without the specific shape of the embossed protrusions which can only be formed after embossing the tissue product. Secondly, it has been surprisingly found that absorbency is better than that of a comparable tissue product for which a reduced overall thickness was achieved by selecting a smaller nip in the embossing operation. An important advantage of the disclosed embodiments of the tissue product is its highly increased softness which applies both to individual sheets of the tissue product and a roll of such tissue product.

Embodiments of the tissue product and its underlying technology can be used in two ways. Either the performance in terms of softness and absorbency is the same for a product with reduced thickness, or a tissue product of the same thickness achieves an improved performance or a different balance of its performance.

According to an embodiment, the embossed protrusions have a generally omega-shaped cross-section in a plane cutting through the side wall and the top surface. The plane cutting through the side wall and the top surface extends in the height direction of the embossed protrusions.

A generally omega-shaped cross-section is a specific geometry of the embossed protrusion with an indent region shaped such that the region of the sidewall folding towards the interior volume of the embossed protrusion is closer to the base than to the top surface of the embossed protrusion. Such specific geometry contributes to the high softness of the surface of the tissue product because the individual embossed protrusions at the upper side of the "omega" can be easily depressed. The indent region is bending towards the interior volume of the cylinder defined by the second cross-sectional area.

Depending on the overall cross-sectional geometry of the embossed protrusions in a plane cutting through the side wall and the top surface, such cross-sectional geometry can also be generally of a dovetail shape.

In an embodiment, the embossed protrusions include a first cross sectional area at the base, a second cross-sectional area at the top surface parallel to the first cross-sectional area, and a third cross-sectional area between and parallel to the first and second cross-sectional areas. The third cross-sectional area is smaller than both the first and second cross-sectional areas.

The provision of a geometry of the embossed protrusions in which the third cross-sectional area is smaller than the first and second cross-sectional areas, defines a considerable degree of inward folding of the sidewall. Because of the underlying technical constraints, for a conventional embossed protrusion, the side wall between the cross-sectional area at the base and the second cross-sectional area top surface is inclined relative the direction perpendicular to the planar extension of the tissue product. Therefore, for a conventional embossed protrusion, the second cross-sectional area at the top is smaller than the first cross-sectional area at the base and any further cross-sectional area between the base and top surface. Common inclination angles are between 25° and 30°. Such geometry is also provided in the initial embossed protrusion. Thus, the provision of a third cross-sectional area which is smaller than the second cross-sectional area at the top or close to the top of the embossed protrusion reflects a high degree of folding inwards of the sidewall of the embossed protrusion.

In an embodiment, the indent region running around the circumference of the embossed protrusion extends into the volume of a virtual truncated cone formed by the first cross-sectional area, the second cross-sectional area and the mantle surface connecting the circumference of the first cross-sectional area and the circumference of the second cross-sectional area.

According to an embodiment, the third cross-sectional area between and parallel to the first and second cross-sectional areas is at least 2%, at least 5%, at least 10%, at least 25%, at least 40%, at least 50%, or at least 60% smaller than the second cross-sectional area at the top surface.

In certain embodiments, the height of indent region over the base of the embossed protrusion is at least 5%, at least 10%, at least 15%, at least 20%, or at least 30% of the total height of the embossed protrusion extending from the first cross-sectional area at the base to the second cross-sectional area at the top surface.

This small ratio of the height of the indent region relative to the total height of the embossed protrusion reflects the pronounced bending or folding of the indent which is only formed in a limited local section of the sidewall of the embossed protrusion close to its base.

In a particular embodiment, the indent region fully surrounds the embossed protrusion.

According to an embodiment, the density of the embossed protrusions is at least 2 protrusions/$cm^2$, at least 5 protrusions/$cm^2$, at least 10 protrusions/$cm^2$, 20 protrusions/$cm^2$, at least 30 protrusions/$cm^2$, at least 40 protrusions/$cm^2$, or at least 50 protrusions/$cm^2$.

The disclosed technology works for any densities of the embossed protrusions but it is more efficient if the density is high. It has been found that a higher density of the embossed protrusions contributes to the perceived softness of the product. Further, the absorbency performance also increases with the density of the embossed protrusions. There is a roughly linear relationship between the density of embossed protrusions and the absorbency of the tissue product.

The embossed protrusions may have a minimum diameter at the top surface of about 0.3 mm, preferably about 0.4 mm, more preferably about 0.5 mm, even more preferably about 0.6 mm, even more preferably about 0.8 mm, and most preferably about 1 mm.

In certain embodiments, the height of the embossed protrusions is between 0.1 mm and 5 mm, preferably between 0.1 mm and 2 mm, more preferably between 0.2 mm and 1 mm, even more preferably between 0.2 mm and 0.8 mm, and most preferably between 0.25 mm and 0.5 mm.

It has been found that a higher height of the embossed protrusions improves both the perceived softness of the product and improves the aesthetic appearance of the product.

According to an embodiment, the angle between the overall slope of the side wall of the embossed protrusions and the direction perpendicular to the base is less than 40°, less than 30°, or less than 28°. Such an angle promotes the inwards folding of the sidewall when compressing the initial embossed protrusion and reducing the initial height. If the angle is too high, the tendency of the material of the sidewall increases to move in an outwards direction instead of folding inwards as desired.

In particular embodiments, the embossed protrusions have a generally truncated shape.

Such truncated shape, especially for the initial protrusions, is beneficial because when compressing the initial protrusions by applying pressure to their top surfaces, a relatively flat top surface will promote the inwards folding of the sidewall of the protrusions.

In an embodiment, the tissue product further includes one further ply, wherein the embossed protrusions extend towards the at least one further ply, and wherein the embossed protrusions are arranged relative to the further ply to form a nested arrangement.

In a multi-ply product, the advantages and especially the improved softness and absorbency are more pronounced as compared to a single ply product.

Both for a single ply product and a multi-ply product, all types of tissue webs can be used. It is possible to use structured tissue webs, e.g. TAD tissue webs as well as conventional dry creped tissue webs. Multi-ply products can also be hybrid products when it is desired to manufacture a product with a high degree of two-sidedness.

The best results are observed when a nested arrangement is used, but the plies can also be combined in a pin-to-pin arrangement or a pin-to-flat arrangement of the plies including the embossed protrusions according to an embodiment of the invention and another ply.

In certain embodiments, the plies are adhesively bonded to each other, for example using glue. In particular embodiments, the glued is colored glue.

For laminating together the single webs, different types of adhesive can be used. Suitable adhesives are, inter alia, glue on the basis of starch or modified starch like for example methyl cellulose or carboxylized methyl cellulose and adhesively acting polymers on the basis of synthetic resins, caoutchouc, polypropylene, polyisobutylene, polyurethane, polyacrylates, polyvinylacetat or polyvinyl alcohol. Such adhesives can also contain dyes in order to improve the optical appearance of the finished products. Frequently, water based glues are used for laminating together paper layers.

In certain embodiments, when laminating together a top ply and a further ply by means of an adhesive, the adhesive is supplied to the protruding parts of the embossing roll. This technique for applying the adhesive can be used in combination with all predominantly used manufacturing techniques like the Goffra Incolla-type processing, a Pin-to-Pin lamination of two plies and a embossing device in which two plies are combined using a Nested-method. In an attempt to influence the mechanical behavior of the multi-ply fibrous product, the adhesive can be applied selectively on specific protrusions of the embossing roll. In other words, the adhesive is not applied to all protrusions but only in selected sections of the embossing roll so that the overall ratio of the surface area in which adhesive has been applied relative to the overall surface area can be varied within a broad range. The use of an adhesive is another means to influence the technical properties of the combined product, especially the overall stiffness of the fibrous product. If colored adhesives are used, this is selected in order to give a specific optical appearance to the product.

According to an embodiment, the fraction of the surface area between the plies which is covered with an adhesive is more than 5% and less than 80%, or between 15% and 60% or between 20% and 50%. For standard multi-ply paper products with a nested arrangement of at least two embossed plies, the fraction of the surface area covered with adhesive is conventionally between 3% and 8%. From this comparison to conventionally used surface area fractions covered with adhesive, it follows that the product of embodiments disclosed herein might have a much larger proportion of the overall area covered with adhesive. Such a high surface area which can be between 15% and 60% results in a stiff product which can be especially useful for napkins.

In order to combine a plurality of plies and especially two plies together, the plies can be adhesively bonded together at the tips of the embossing patterns of the plies facing each other.

An embodiment of a method for producing a tissue product in accordance with the embodiments disclosed above includes:

(a) embossing the tissue material in an embossing unit for embossing the single web and/or embossing and laminating a multi-ply tissue web;
(b) compressing embossed tissue web in a protrusion compression unit in order to reduce its thickness; and
(c) directing the tissue web through a rewinding station.

In certain embodiments, the protrusion compression unit is either upstream of the rewinding station or an integral part of the rewinding station. In other words, in step (a), a tissue product with initial embossed protrusions is generated, and in subsequent step (b), the tissue product runs through a protrusion compression unit in which the specific shape of the embossed protrusion is generated which is bent towards the interior volume of the embossed protrusion.

According to an embodiment, the operation of the protrusion compression upstream of the rewinding station includes directing the embossed tissue web into the gap between two parallel rolls, wherein the gap between the two parallel rolls has a size between 0 mm and 0.3 mm. Such protrusion compression station upstream of the rewinding station is the first alternative solution which is independent of the rewinding or folding step and can be freely adjusted to specific needs. Depending on the thickness of the tissue web before the compression step and depending on the desired thickness of the final tissue product, the gap between the two compression rollers can be adjusted. A gap size of 0 mm is possible because of the spring back elasticity of the tissue material after the compression step. The selected gap size is relatively small in order to generate the desired shape of the embossed protrusions with the bending of the sidewalls of the protrusions towards the interior volume of the protrusions.

As an alternative embodiment, the protrusion compression unit is an integral part of the rewinding station and includes a driven roll and a second roll parallel to the driven roll and not driven, wherein the embossed tissue web is compressed in the gap between the driven roll and the second roll. With such an arrangement, the overall complexity of the apparatus can be reduced because the usually employed infeed draw rolls of the rewinder can have a double function and also serve the purpose to compress the tissue web while generating a sufficient holding force to firmly hold the tissue web. In particular embodiments, the protrusion compression unit includes a motor-driven draw roll and a non-driven second, cooperating roll which are arranged within the rewinding device. The draw roll can be made of a stellite alloy.

In particular embodiments, the disclosed method further includes, after step (c):

(d1) rolling the tissue web to obtain a rolled tissue material product.

According to an alternative embodiment, the disclosed method further includes, after step (c):

(d2) folding the tissue web to obtain a folded tissue product.

Embodiments of the disclosed method are applicable to any product specification. It works both for folded products and rolled products.

In particular embodiments, the disclosed method further includes perforating the tissue web before step (d1) or (d2).

An apparatus for carrying out embodiments of the disclosed method includes an embossing unit for embossing the single web or embossing and/or laminating a multi-ply tissue web; a protrusion compression unit for reducing the thickness of the embossed tissue web; and a rewinding station. In particular embodiments, the protrusion compression unit is either upstream of the rewinding station or integral part of the rewinding station.

According to an embodiment, the apparatus further includes either a winding unit for forming a roll of the tissue product or a folding unit for providing a folded tissue product; and/or a perforating unit for perforating the tissue web in predetermined intervals perpendicular to the longitudinal extension of the tissue web.

For rolled products, the web length per roll can be increased without compromising the softness and absorbency of the product because embodiments of the tissue product realize such characteristic properties with a reduced overall thickness as compared to conventional products. For folded products, the number of sheets for a given height of the stack can be increased because of the reduced thickness of the individual sheets stacked onto each other.

The fibrous tissue product according to embodiments of the invention can be a tissue paper product, non-woven product or a hybrid thereof, for example a hygiene and cleaning product.

The term non-woven according to ISO 9092, DIN EN 29092 is applied to a wide range of products which, in terms of their properties are located between those of paper (DIN 6730, May 1996) and cardboard (DIN 6730) on the one hand, and textiles on the other hand. As regards non-wovens, a large number of extremely varied production processes are used, such as the air-laid and spun-laced techniques as well as the wet-laid techniques. The non-wovens include mats, non-woven fabrics and finished products made thereof. Non-wovens may also be called textile-like composite materials, which represent flexible porous fabrics that are not produced via the classic methods of weaving warp and weft or by looping. In fact, non-wovens are produced by intertwining, cohesive or adhesive bonding of fibers, or a combination thereof. The non-woven material can be formed of natural fibers, such as cellulose or cotton fibers, but can also be made of synthetic fibers such as polyethylene (PE), polypropylene (PP), polyurethane (PU), polyester, fibers on the basis of polyethylenterephtalate, polyvinyl alcohol, nylon or regenerated cellulose or a mix of different fibers. The fibers may, for example, be present in the form of endless fibers or pre-fabricated fibers of a finite length, as synthetic fibers, or in the form of staple fibers. The non-wovens as mentioned herein may thus be made of mixtures of synthetic and cellulose fibrous material, e.g. natural vegetable fibers (see ISO 9092, DIN EN 29092).

The terms "hygiene products" and "cleaning products" as used herein include bathroom tissue, household towels, handkerchiefs, facial tissues, napkins, wiping and cleaning products as well table ware.

The device for producing fibrous products can include an embossing roll and a cooperating anvil roll. The anvil roll can be made of rubber like EPDM or NBR (nitrylbutadien rubber), paper or steel.

In particular embodiments, the anvil roll has a hardness between 20 Shore A and 85 Shore A or between 35 Shore A and 60 Shore A or a hardness of about 45 Shore A.

For a multi-ply tissue product, the device can include a marrying roll running against the embossing roll for bonding together the at least one top ply and at least one further ply. Such marrying roll is used in the conventional Goffra Incolla type process and for an embossing machine providing a nested arrangement of two embossed plies. However, a marrying roll is not necessary in case of a direct bonding together of two embossed plies using the above-described Pin-to-Pin ply bonding in which the tips of the embossing patterns of two plies face each other and are laminated together at such tips. In such a case, the device can include a further embossing roll running against the disclosed embossing roll for embossing at least one further ply. It is possible to use a conventional embossing roll which applies conventional embossing elements to the further ply such that in selected positions relative to the embossing roll processing the top ply, the tips of the embossing elements generated with both embossing rolls face each other in order to achieve a Pin-to-Pin arrangement and bonding of the two plies.

DETAILED DESCRIPTION OF PARTICULAR EMBODIMENTS

Figure 1:
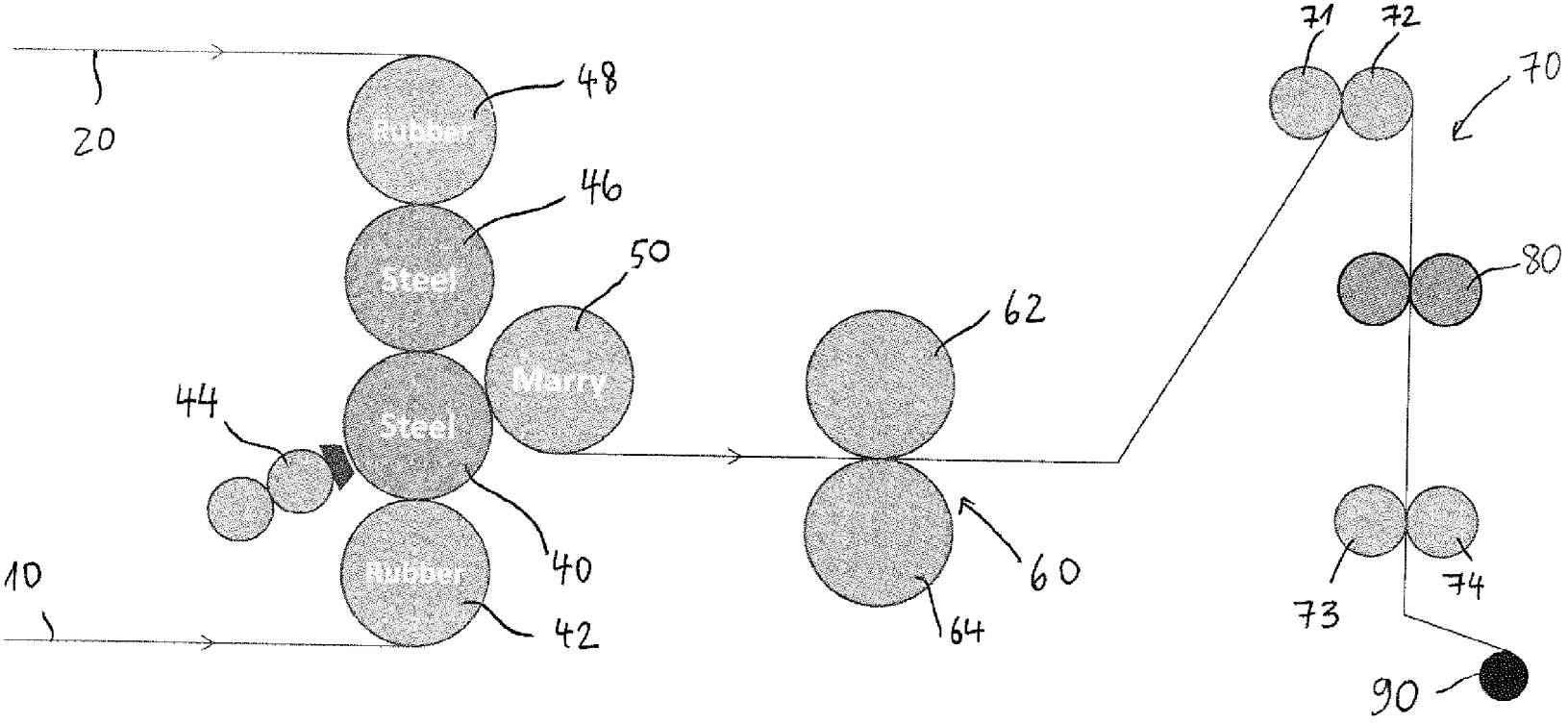
FIG. 1 schematically shows an embodiment of a process for manufacturing an embodiment of the tissue product.

In the following description of particular embodiments, the same reference numerals will be used for the same or similar elements.

Figure 4:
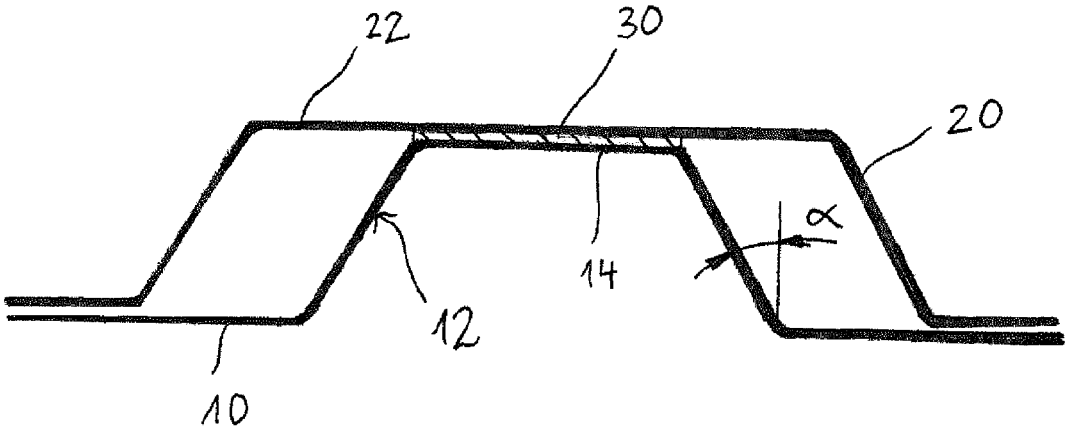
Fig. 4 PRIOR ART
FIG. 4 shows a cross-sectional view of a conventional two-ply tissue product.

In FIG. 4, a cross-sectional view of a conventional two-ply tissue product is shown. A ply 10 of tissue material is provided with an embossed protrusion 12. In the example according to FIG. 4, the ply 10 is laminated to a second ply 20 in a nested arrangement. To this end, the second ply 20 is also provided with an embossed protrusion 22. The embossed protrusion 12 of the first ply 10 is arranged such that it extends into the embossed protrusion 22 of the second ply. Ply bonding between the plies 10 and 20 is achieved by means of a glue 30 applied to the top surface 14 of the embossed protrusion 12 before the two plies 10, 20 are laminated together in a conventional way. The embossed protrusion of FIG. 4 has a sloped sidewall connecting the top surface of the embossed protrusion and its base.

Figure 2:
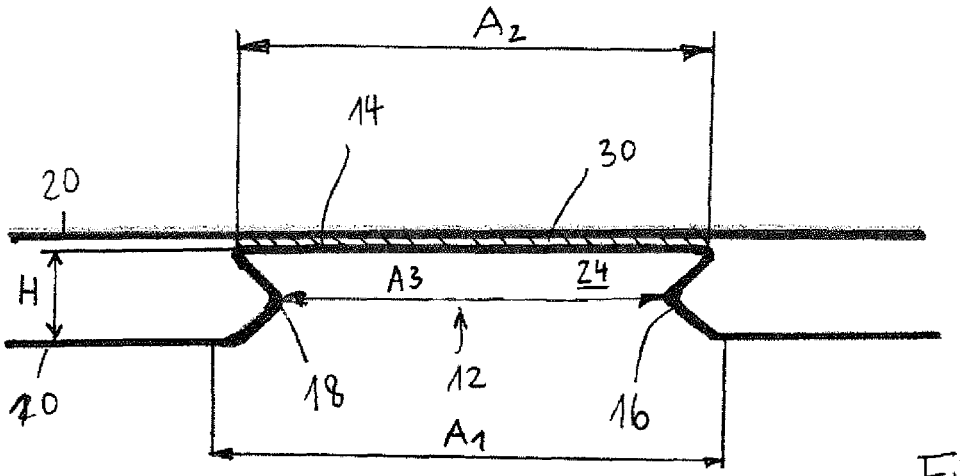
FIG. 2 schematically shows a cross-sectional view of an embodiment of a two-ply tissue product with an embossed protrusion.
Figure 3:
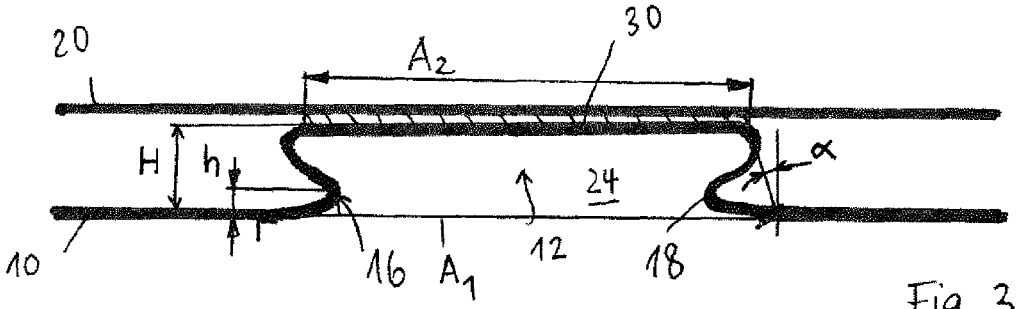
FIG. 3 schematically shows a cross- sectional view of another embodiment of a two-ply tissue product with an embossed protrusion.

Cross-sectional views of embossed protrusions in embodiments of a tissue product are shown with reference to FIGS. 2 and 3. In the examples of FIGS. 2 and 3, the two plies 10 and 20 are arranged in a pin to flat arrangement. This, however, is only an example and a nested arrangement as shown in the example of the conventional product in FIG. 4 is also possible like the arrangement of two plies in a pin-to- pin arrangement. Further, it should be noted that, although the specific examples of FIGS. 2 and 3 only refer to a two-ply product, the tissue product can be a single ply product, or can have more than two plies.

As shown in both FIGS. 2 and 3, the embossed protrusion 12 is provided with a top surface 14 adhesively bonded with glue 30 to the second ply 20. Further, the sidewall 16 is provided with an indent region 18 within a certain part of the sidewall 16 in which the sidewall bends towards the interior volume 24 of the embossed protrusion 12. Although in the drawings, only cross-sectional views are shown, the indent regions in which the sidewall bends towards the interior volume of the embossed protrusions runs all around the embossed protrusion.

As can be seen in FIGS. 2 and 3, the embossed protrusions 12 are compressed. Their height H is between 0.1 mm and 10 mm, between 0.2 mm and 8 mm, or between 0.25 mm and 5 mm. The shape of the embossed protrusions is such that they form an undercut in the indent region. Such indent region cannot be formed by using a conventional embossing process because an embossing protrusion in a conventional embossing roll cannot be shaped such that it generates such an undercut geometry of an embossed protrusion.

When defining a first cross-sectional area $A_1$ at the base and a second cross-sectional area $A_2$ at the top surface 14 of the embossed protrusion 12, it can be seen that, like in the conventional embossed protrusion as shown in FIG. 4, the second cross-sectional area $A_2$ is smaller than the first cross-sectional area $A_1$. However, what is striking is that a third cross-sectional area $A_3$ between and parallel to the first and second cross-sectional areas $A_1$, $A_2$ can be defined at the indent region. This cross-sectional area $A_3$ is smaller than both the other two cross-sectional areas $A_1$, $A_2$ which characterizes the bending inwards of the sidewall 18 of the embossed protrusion 12.

In particular embodiments, the cross-sectional area $A_3$ is at least 2% and up to 60% smaller than the second cross-sectional area $A_2$ at the top surface of the embossed protrusion.

Further, it can be seen in FIG. 2 that the sidewall 16 of the embossed protrusion 12 folds inwards with relatively sharp turns which only have a very small radius. A slightly different geometry to that as shown in FIG. 2 is shown in FIG. 3 which can be compared generally to an Ω-shape. The indent region 18 of the embossed protrusion 12 is relatively close to the continuous base surface of the tissue web including the first cross-sectional area $A_1$. The position at which the sidewall 16 has the most pronounced extension towards the interior volume 24 of the embossed protrusion is where the third cross-sectional area $A_3$ is defined. As can be seen in FIG. 3, the third cross-sectional area $A_3$ is at a height h above the base at the position of the first cross-sectional area $A_1$. In particular embodiments, the height h of the third cross-sectional sectional area $A_3$ above the first sectional-area $A_1$ is considerably smaller than the height H between the first cross-sectional area $A_1$ and the second cross-sectional area $A_2$. The height h ranges between 5% and 30% of the total height H of the embossed protrusion 12.

Further, in FIG. 3 the slope of the embossed protrusion 12 is shown. It can be defined as the angle between the extension perpendicular to the base surface of the web and the imaginary line connecting the rim of the first cross-sectional surface area $A_1$ at the base and the rim of the second cross-sectional surface area $A_2$ at the top surface of the embossed protrusion 12. The slope defines the initial shape of the embossed protrusion (not shown) which is similar to that as shown in FIG. 4 but before the compression leading to the claimed shape with the indent region 16 took place. For easy reference, the slope angle $\alpha$ is also shown in FIG. 4 referring to the conventional geometry of the embossed protrusion.

With respect to the dimensions of an embossed protrusion 12, the tissue product was found to show good properties if the embossed protrusions 12 has a minimum diameter at the base of about 0.3 mm, preferably of about 0.4 mm. In an embodiment, the minimum diameter at the base is about 1 mm. The minimum diameter at the top surface is about 0.3 mm. In an embodiment, the minimum diameter at the top surface of the embossed protrusions is about 1 mm. With respect to the density of the protrusions on the ply 10, it was found to provide good properties in terms of absorbency and softness if there are at least 2 protrusions/$cm^2$, or at least 5 protrusions/$cm^2$. The best results were achieved if there are at least 10 protrusions/$cm^2$ and up to 50 protrusion/$cm^2$.

In FIG. 1, the general process for manufacturing a product according to FIG. 2 or FIG. 3 is shown. Referring to a two-ply or three-ply embossing and lamination apparatus, the ply 10 is embossed in the nip between a first embossing roll 40 and a cooperating anvil roll 42. In particular embodiments, the embossing roll 40 is made of steel, whereas the cooperating anvil roll 42 is made of rubber. When the ply 10 has been embossed and runs over the embossing surface of the steel embossing roll 40, adhesive is applied to the top surfaces of the embossed protrusions by means of the glue applicator device 44 as is conventionally used. It can be used to apply colored glue to all or a part of the embossed protrusions. The second ply 20 also runs through the embossing nip of a steel embossing roll 46 and a rubber anvil roll 48. Such an embossing equipment, however, can be omitted if, like in the case of FIGS. 2 and 3, a pin-to-pin flat arrangement of the two plies is contemplated. If, however, a nested arrangement of the plies 10 and 20 of the plies 10 and 20 is contemplated, the second embossing station with the steel embossing roll 46 and the rubber anvil roll 48 is used.

The two plies 10 and 20 are laminated together by means of a conventional marrying roll 50 cooperating with the steel embossing roll 40. By means of the marrying roll 50 made of an elastic material, the plies 10 and 20 pressed together and laminated together by means of the glue which has been aligned by means of the glue applicator device 44. The two-ply product which received a conventional embossing is directed to a protrusion compression unit 60 which includes two cooperating rolls 62, 64 which are arranged with a very small gap in-between. The protrusion compression unit 60 works like a calendaring unit known in the prior art but with a very small gap which is specifically adapted to the desired result of the protrusion compression unit. The size of the gap depends on the number of plies of the product and on the desired thickness of the product and ranges between 0 mm and 0.3 mm. Depending on the selection of the gap and the geometry of the embossed protrusions, different degrees of compression leading to different geometries of the compressed embossed protrusions will be generated.

After the protrusion compression unit 60, which serves as a dot-folding unit, the tissue web with reduced thickness is directed to a rewinder 70 including infeed draw rolls 71, 72 and outfeed draw rolls 73, 74. Between the infeed draw rolls and outfeed draw rolls, perforation of the web might be performed at a perforating station 80 which is operated in a conventional way.

After leaving the rewinder 60 incorporating an optional perforating station 80, the product is directed to a further processing unit 90 which might either windup the tissue product to a roll or fold it into a stack of individual sheets.

Figure 5:
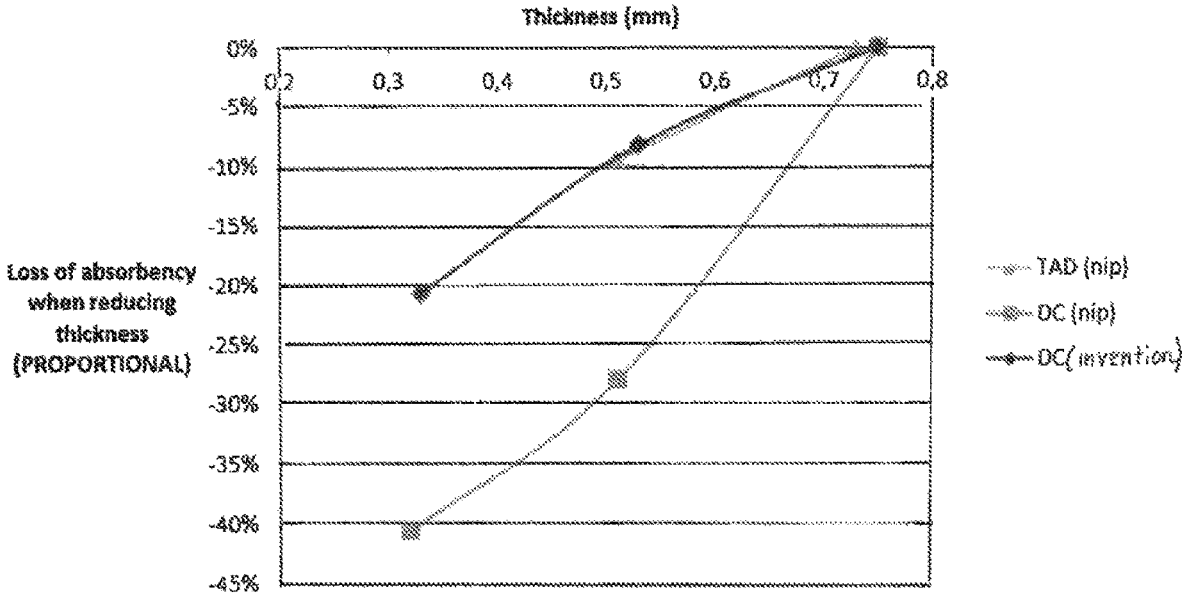
FIG. 5 shows a table comparing a tissue product according to an embodiment of the invention to a conventional product.

In Table 1 as shown in FIG. 5, a tissue product according to an embodiment of the invention is compared to a conventional product (lower curve) marked "DC (nip)" which is a product with a smaller nip in the conventional embossing station so that a smaller degree of embossing takes place.

Such product which received a lower degree of embossing has a pronounced reduction of absorbency when reducing the thickness of the product. The product according to the embodiment of the invention with the "folded" sidewalls of the compressed embossing protrusions also has a lower absorbency with reduced thickness of the product. However, the decrease of absorbency when reducing the thickness is only about half of that of a conventional product using a smaller nip with a lower degree of embossing. As a result, the product according to the embodiment of the invention is brought to the level of a conventional TAD product "TAD (nip)" which is conventionally superior with respect to the loss of absorbency when reducing the thickness as compared to dry creped products like that according to an embodiment of the invention and the comparative example with the smaller nip ("DC (nip)"). It can be seen that the tissue product according to an embodiment of the invention can be provided with a reduced thickness without suffering from a largely reduced absorbency as is common in conventional products.

Besides the superior properties in absorbency, the perceived softness of the tissue product according to an embodiment of the invention is superior to a product in which a smaller degree of embossing is provided by means of a smaller nip in the embossing station. Also in comparison to a product in which the thickness is reduced by rewinding the tissue web with high tension, the perceived softness both of the individual sheets of tissue product and a roll of tissue product is higher according to embodiments of the invention.

Therefore, the tissue product according to embodiments of the invention are especially useful when a product with low thickness is contemplated which has a long paper length per roll. Among conventional products with such properties, the product according to embodiments of the invention has a higher softness because of the very specific shape of the embossed protrusions.

The invention claimed is:

1. A tissue product, comprising at least one ply with embossed protrusions defining an interior volume, the embossed protrusions comprising a base, a top surface and a sidewall extending from the top surface to the base, wherein the sidewall of at least 10% of the embossed protrusion is provided with an indent region shaped such that the sidewall bends towards the interior volume of the embossed protrusion.

2. The tissue product according to claim 1, wherein the embossed protrusions have general omega-shaped cross-section in a plane cutting through the sidewall and the top surface.

3. The tissue product according to claim 1, wherein the embossed protrusions comprise a first cross-sectional area ($A_1$) at the base, a second cross-sectional area ($A_2$) at the top surface parallel to the first cross- sectional area ($A_1$), and a third cross-sectional area ($A_3$) between and parallel to the first and second cross-sectional areas ($A_1$, $A_2$), wherein the third cross-sectional area ($A_3$) is smaller than both the first and second cross-sectional areas ($A_1$, $A_2$).

4. The tissue product according to claim 3, wherein the third cross-sectional area ($A_3$) between and parallel to the first and second cross-sectional areas ($A_1$, $A_2$) is at least 2% smaller than the second cross-sectional area ($A_2$) at the top surface.

5. The tissue product according to claim 3, wherein the height (h) of the indent region over the base of the embossed protrusion is at least 5% of the total height (H) of the embossed protrusion extending from the first cross-sectional area ($A_1$) at the base to the second cross-sectional area ($A_2$) at the top surface.

6. The tissue product according to claim 1, further comprising at least one further ply, wherein the embossed protrusions extend towards the at least one further ply.

7. The tissue product according to claim 1, wherein the indent region runs around the circumference of the embossed protrusion and extends into the volume of a virtual truncated cone formed by the first cross-sectional area ($A_1$), the second cross-sectional area ($A_2$) and a mantle surface connecting the circumference of the first cross-sectional area ($A_1$) and the circumference of the second cross-sectional area ($A_2$).

8. The tissue product according to claim 1, wherein the indent region fully surrounds the embossed protrusion.

9. The tissue product according to claim 1, wherein the density of the embossed protrusions is at least 2 protrusions/$cm^2$.

10. The tissue product according to claim 1, wherein the embossed protrusions have a minimum diameter at the top surface of about 0.3 mm.

11. The tissue product according to claim 1, wherein the height (H) of the embossed protrusions is between 0.1 mm and 5 mm.

12. The tissue product according to claim 1, wherein the angle (α) between the overall slope of the sidewall of the embossed protrusions and the direction perpendicular to the base is less than 40°.

13. The tissue product according to claim 6, wherein the plies are adhesively bonded to each other.

14. A method of producing a tissue product according to claim 1, comprising:

(a) embossing a tissue material in an embossing unit for embossing a single web and/or embossing and laminating a multi-ply tissue web to create the embossed protrusions;

(b) compressing the embossed tissue web in a protrusion compression unit in order to reduce its thickness and create the indent region of the sidewalls; and (c) directing the tissue web through a rewinding station.

15. The method of producing a tissue product according to claim 14, wherein the protrusion compression unit is either upstream of the rewinding station or an integral part of the rewinding station.

16. The method according to claim 15, wherein the operation of the protrusion compression unit upstream of the rewinding station comprises the step of directing the embossed tissue web into the gap between two parallel rolls, wherein the gap between the two parallel rolls has a size between 0 mm and 0.3 mm.

17. The method according to claim 14, wherein the protrusion compression unit is an integral part of the rewinding station and comprises a driven roll and a second roll parallel to the driven roll and not being driven, wherein the embossed tissue web is compressed in the gap between the driven roll and the second roll.

18. The method according to claim 14, further comprising, after step (c):

(d1) rolling the tissue web to obtain a rolledtissue material product.

19. The method according to claim 14, further comprising, after step (c):

(d2) folding the tissue web to obtain a folded tissue product.

20. The method according to claim 18, further comprising perforating the tissue web before step (d1) or (d2).

21. An apparatus for carrying out the method according to claim 14, comprising:

an embossing unit for embossing a single web or embossing and/or laminating a multi-ply tissue web;

a protrusion compression unit for reducing the thickness of the embossed tissue web and creating the indent region of the sidewalls; and a rewinding station.

22. The apparatus according to claim 21, wherein the protrusion compression unit is either upstream of the rewinding station or integral part of the rewinding station.

23. The apparatus according to claim 22, further comprising:

either a winding unit for forming a roll of the tissue product or a folding unit for providing a folded tissue product; and/or a perforating unit for perforating the tissue web in predetermined intervals perpendicular to the longitudinal extension of the tissue web.

* * * * *